US011434782B2

(12) United States Patent
Kang et al.

(10) Patent No.: US 11,434,782 B2
(45) Date of Patent: Sep. 6, 2022

(54) METHOD OF HIGH CONCENTRATION TOXIC GAS EMISSION DURING CHEMICAL STRIPING OF GAS TURBINE HIGH TEMPERATURE COMPONENTS

(71) Applicants: Hyun Ki Kang, Busan (KR); Tae Woo Noh, Busan (KR); Sung Hoon Jung, Changwon-si (KR); Ta Kwan Woo, Busan (KR)

(72) Inventors: Hyun Ki Kang, Busan (KR); Tae Woo Noh, Busan (KR); Sung Hoon Jung, Changwon-si (KR); Ta Kwan Woo, Busan (KR)

(73) Assignee: SUNGILTURBINE CO., LTD, Busan (KR)

( * ) Notice: Subject to any disclaimer, the term of this patent is extended or adjusted under 35 U.S.C. 154(b) by 0 days.

(21) Appl. No.: 17/146,811

(22) Filed: Jan. 12, 2021

(65) Prior Publication Data

US 2021/0324760 A1 Oct. 21, 2021

(30) Foreign Application Priority Data

Apr. 17, 2020 (KR) ..... 10-2020-0046955

(51) Int. Cl.

| | |
|---|---|
| ***F01D 25/00*** | (2006.01) |
| ***B08B 3/08*** | (2006.01) |
| ***B08B 9/00*** | (2006.01) |
| ***B08B 15/00*** | (2006.01) |

(52) U.S. Cl.

CPC ..... *F01D 25/002* (2013.01); *B08B 3/08* (2013.01); *B08B 9/00* (2013.01); *B08B 15/00* (2013.01); *F05D 2230/72* (2013.01)

(58) Field of Classification Search

None

See application file for complete search history.

(56) References Cited

U.S. PATENT DOCUMENTS 3,715,282 A * 2/1973 Pries et al. ..... C10B 39/14 202/227

FOREIGN PATENT DOCUMENTS

| | | | |
|---|---|---|---|
| KR | 2020090012028 U | 11/2009 | |
| KR | 1020150120541 A | 9/2016 | |

* cited by examiner

*Primary Examiner* — Eric W Golightly

(74) *Attorney, Agent, or Firm* — John K. Park; Park Law Firm

(57) ABSTRACT

The present invention relates to a method for exhausting high concentrations of toxic gases generated during chemical stripping for high-temperature parts of a gas turbine, the method including the steps of: allowing a pair of openable/closable doors mounted on top of a tank whose top is open to accommodate a chemical substance therein to be closed during the chemical stripping so as to close top of the tank; collecting the toxic gases generated from the interior of the tank through hoods located at the inside of the tank; and exhausting the toxic gases to the outside through exhaust pipes mounted on the hoods or collecting the toxic gases to a separate storage tank.

3 Claims, 6 Drawing Sheets

METHOD OF HIGH CONCENTRATION TOXIC GAS EMISSION DURING CHEMICAL STRIPING OF GAS TURBINE HIGH TEMPERATURE COMPONENTS

BACKGROUND OF THE INVENTION

Cross Reference to Related Application of the Invention

The present application claims the benefit of Korean Patent Application No. 10-2020-0046955 filed in the Korean Intellectual Property Office on 17,04,2020, the entire contents of which are incorporated herein by reference.

Field of the Invention

The present invention relates to a method for exhausting high concentrations of toxic gases generated during chemical stripping for high-temperature parts of a gas turbine that is capable of preventing the high concentrations of toxic gases generated during the chemical stripping for the high-temperature parts (blade and vane) of the gas turbine, particularly, the high concentrations of toxic gases generated from hydrochloric acid, from being exhausted to the outside and allowing the toxic gases generated from an interior of a tank to be exhausted to the outside through exhaust pipes connected to hoods or collected to a separate storage tank.

Background of the Related Art

Chemical stripping is the process of chemically dissolving and removing a metal film as a high-temperature oxidation resistant bond coating layer.

Generally, toxic gases are generated during the chemical stripping or deposition, and a conventional method for removing the toxic gases is disclosed in Korean Patent No. 0511564 wherein a catalyst for removing toxic gases and odor materials emitted during chemical processes and a method for manufacturing the catalyst are suggested. First, there is provided the method for manufacturing a catalyst for removing toxic gases and odor materials emitted during chemical processes, the method including the steps of: impregnating 0.1 to 5% by weight of ruthenium and 0.5 to 15% by weight of at least one metal selected from the group consisting of Mn, Ce, Fe, Cu, Sn and Co into a titanium dioxide support having surface area of 20 to 250 $m^2/g$ and 60% by weight of an anatase crystal structure, based on total weight of the titanium dioxide support; and drying the impregnated mixture at a temperature of 60 to 120° C. and sintering the dried mixture at a temperature of 300 to 550° C. under atmospheric air for 3 to 12 hours. Under the conditions of the temperature of 80 to 350° C. and space velocity (SV) of exhaust gas of 1,000 to 80,000 hr-1, the catalyst is used for controlling the toxic gases emitted during the chemical processes.

Another conventional method for removing the toxic gases is disclosed in Korean Patent No. 0238387 wherein a system for continuously purifying toxic gases not reacted includes: a thermal decomposition system that is provided with an exhaust gas inlet pipe, a combustion air inlet, and a nichrome wire heater in such a manner as to allow exhaust gas to be introduced thereinto through the exhaust gas inlet pipe and to be then injected in front of the nichrome wire heater and a water cleaning system that is provided with a combustion gas inlet pipe for introducing the combustion gas from the thermal decomposition system, a gas dispersion plate, a water spray nozzle, and a U-shaped drain pipe for exhausting treatment water in such a manner as to allow the combustion gas dispersed by means of the gas dispersion plate to come into contact with the water sprayed from the water spray nozzle through countercurrent flows, wherein the thermal decomposition system and the water cleaning system are connected to each other. Further, there is provided a method for continuously purifying toxic gases not reacted including the steps of: locating a stainless steel net having 100 meshes at the end portion of the exhaust gas inlet pipe of the thermal decomposition system to allow the toxic gases not reacted to be introduced into the thermal decomposition system in which the nichrome wire heater is built, to be sprayed in front of the nichrome wire heater, and to be thermally decomposed through direct heating of the nichrome wire heater; and allowing the thermally dissolved combustion gas emitted from the thermally decomposed system to be introduced into the water cleaning system in which the gas dispersion plate and the water spray nozzle are built and to be then dispersed by means of the gas dispersion plate, so that the dispersed combustion gas comes into contact with the water sprayed from the water spray nozzle through countercurrent flows to thus remove remaining soluble gases.

In the conventional methods, however, large amounts of substances harmful to the human bodies are contained in the water vapor produced while the chemical substances are being heated, and further, toxic gases are generated from the chemical substances, thereby failing to ensure a worker's safety.

SUMMARY OF THE INVENTION

Accordingly, the present invention has been made in view of the above-mentioned problems occurring in the related art, and it is an object of the present invention to provide a method for exhausting high concentrations of toxic gases generated during chemical stripping for high-temperature parts of a gas turbine that is capable of preventing the toxic gases generated from hydrochloric acid from being exhausted to the outside and allowing the toxic gases produced from an interior of a tank to be exhausted to the outside through exhaust pipes connected to hoods or collected to a separate storage tank.

To accomplish the above-mentioned object, according to the present invention, there is provided a method for exhausting high concentrations of toxic gases generated during chemical stripping for high-temperature parts of a gas turbine, the method including the steps of: allowing a pair of openable/closable doors mounted on top of a tank whose top is open to accommodate a chemical substance therein to be closed during the chemical stripping so as to close top of the tank; collecting the toxic gases produced from the interior of the tank through hoods located at the inside of the tank; and exhausting the toxic gases to the outside through exhaust pipes mounted on the hoods or collecting the toxic gases to a separate storage tank.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE EMBODIMENTS

The present invention relates to a method for exhausting high concentrations of toxic gases generated during chemical stripping for high-temperature parts of a gas turbine, including the steps of: allowing a pair of openable/closable doors mounted on top of a tank whose top is open to accommodate a chemical substance therein to be closed during the chemical stripping so as to close top of the tank; collecting toxic gases generated from an interior of the tank through hoods located at the inside of the tank; and exhausting the toxic gases to the outside through exhaust pipes mounted on the hoods or collecting the toxic gases to a separate storage tank.

Rails are located on both top sides of the tank, and accordingly, the doors slide along the rails to open and close the top of the tank. If the doors are close to each other, the top of the tank becomes closed, and if they are distant from each other, the top of the tank becomes open.

Further, the doors have given heights toward tops thereof, so that they have space portions formed on the undersides thereof in such a manner as to insertedly locate the hoods for collecting the toxic gases generated from the tank thereinto, without having any influence on the doors moving along the rails.

Furthermore, the hoods are located relatively lower than internal ceiling surfaces of the doors between both top sides of the tank, thereby having no influence on the doors moving along the rails.

Also, the tank has stepped protrusions formed on the insides of the both top sides where the rails are located, and plate-shaped covers are seated onto the stepped protrusions to prevent the toxic gases still remaining in the interior of the tank in the state where the doors are open from being exhausted to the outside.

Further, handles are provided on top of each cover in such a manner as to be easily grasped by a worker, and a plurality of induction needles spaced apart from one another at given intervals in every direction are provided on underside of each cover in such a manner as to induce water vapor attached to the undersides of the cover and containing the toxic gases therein to fall down to the tank.

Moreover, porous channels are formed on the inside of the tank to collect the toxic gases generated from the interior of the tank in a state where the covers are seated onto the tank.

Hereinafter, the method for exhausting high concentrations of toxic gases generated during chemical stripping for high-temperature parts of a gas turbine according to the present invention will be in detail explained with reference to FIGS. 1 to 5.

Figure 1:
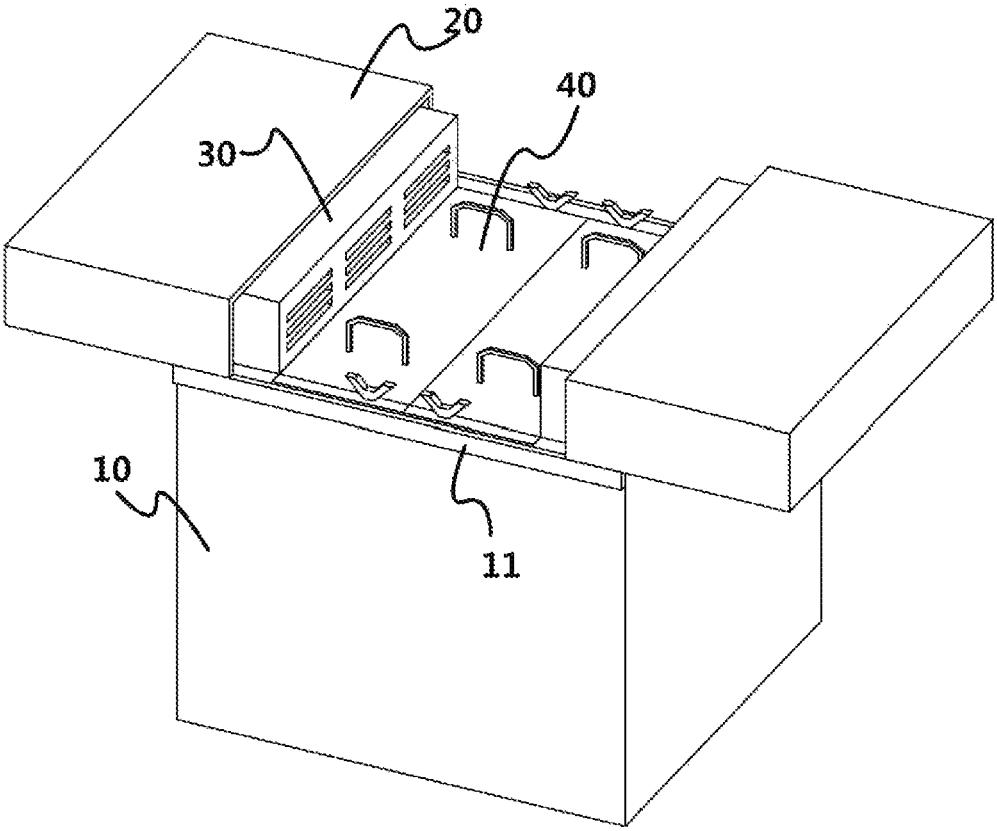
FIG. 1 is a perspective view showing a state where doors located on top of a tank are open in a method for exhausting high concentrations of toxic gases generated during chemical stripping for high-temperature parts of a gas turbine according to the present invention.
Figure 2:
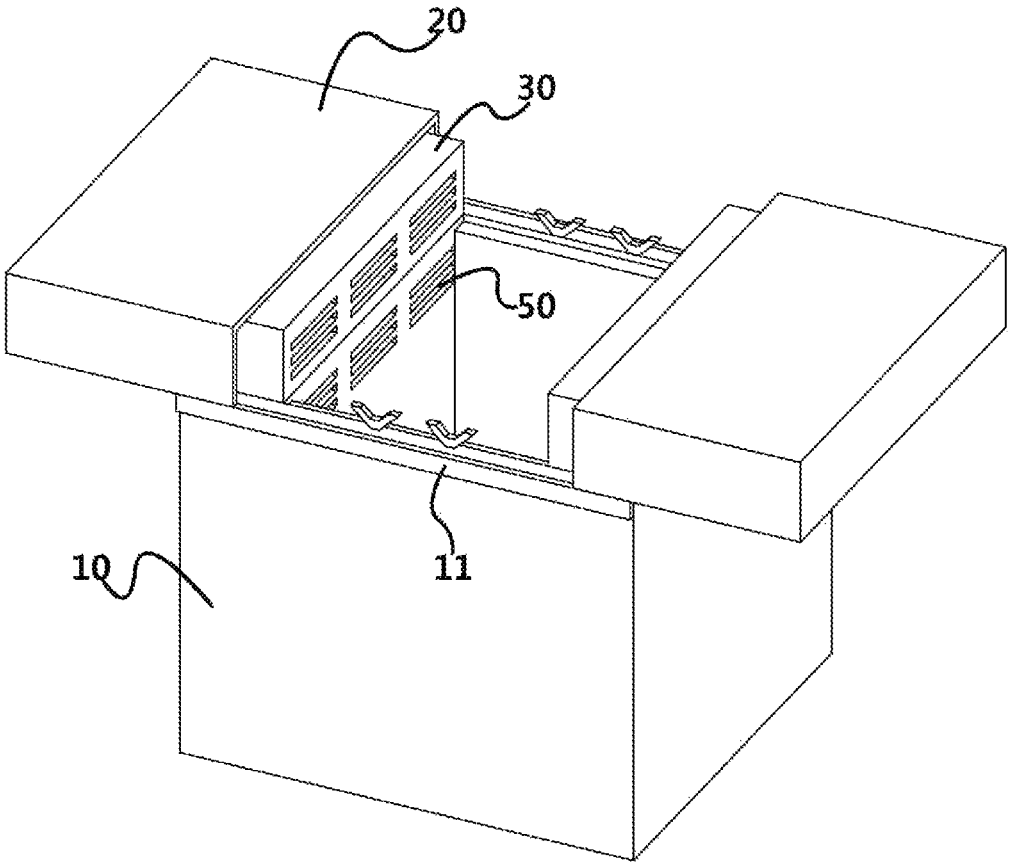
FIG. 2 is a perspective view showing a state where the doors and covers located on top of the tank are open in the method for exhausting high concentrations of toxic gases generated during chemical stripping for high-temperature parts of a gas turbine according to the present invention.
Figure 3:
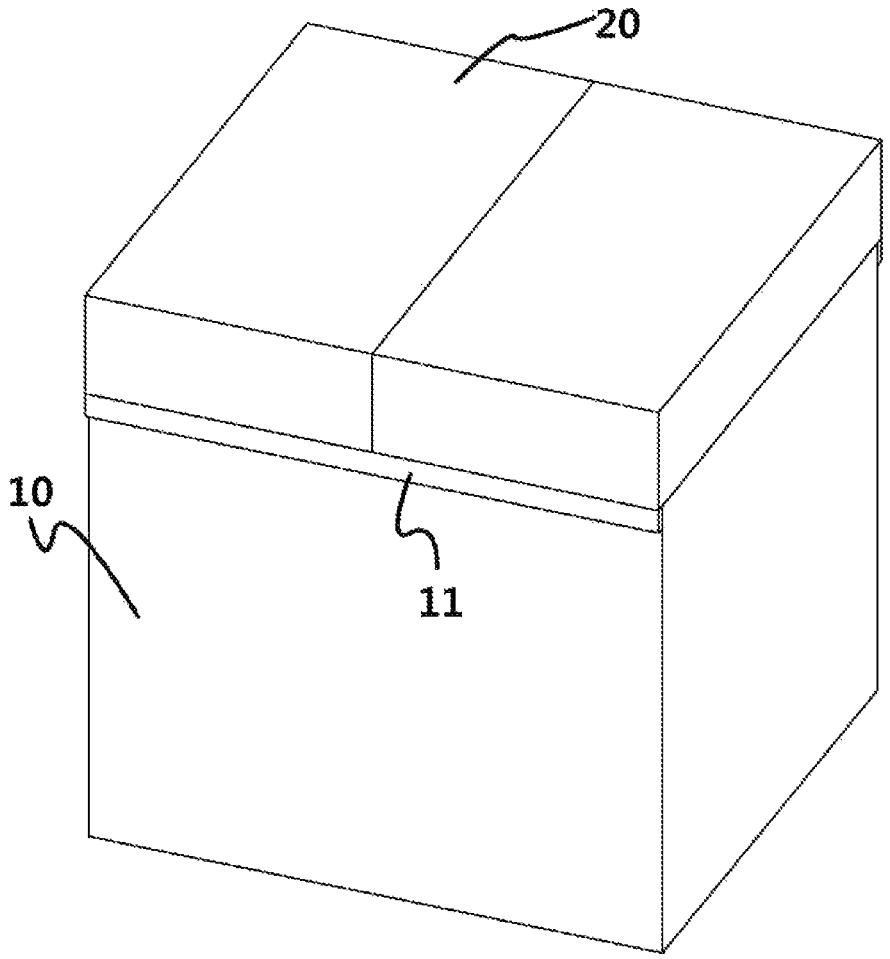
FIG. 3 is a sectional view showing a state where the doors located on top of the tank are closed in the method for exhausting high concentrations of toxic gases generated during chemical stripping for high-temperature parts of a gas turbine according to the present invention.
Figure 4:
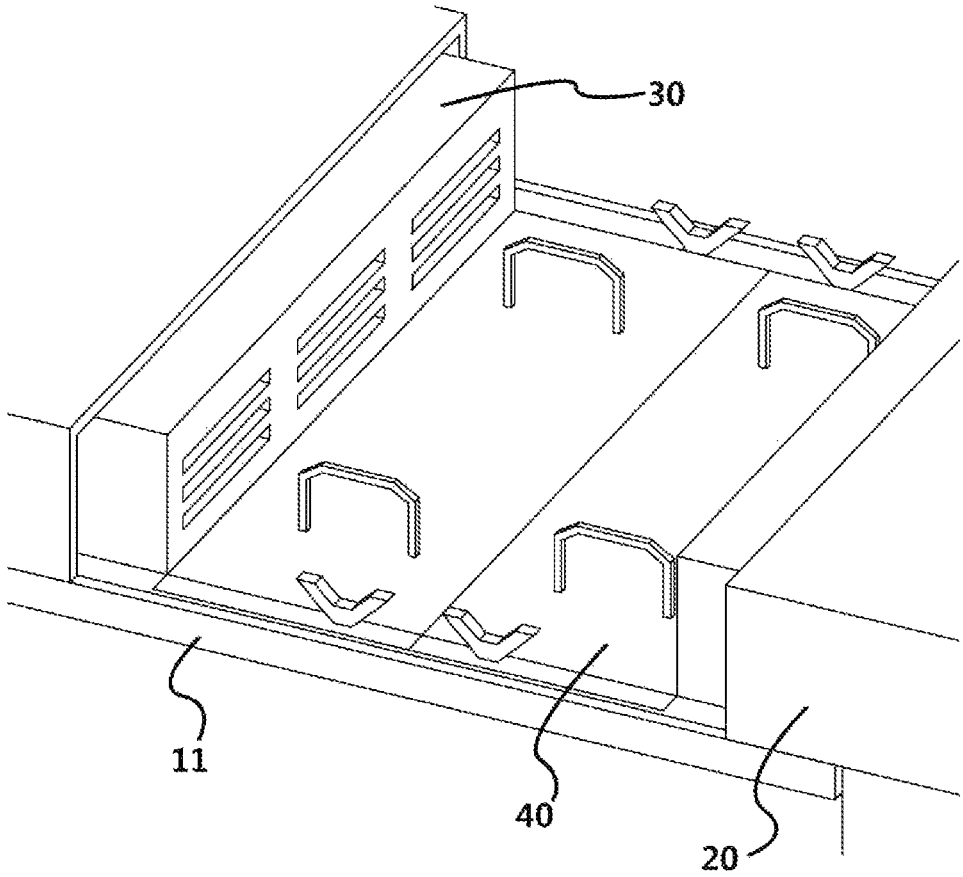
FIG. 4 is an enlarged perspective view showing a portion of top of FIG. 1.
Figure 5:
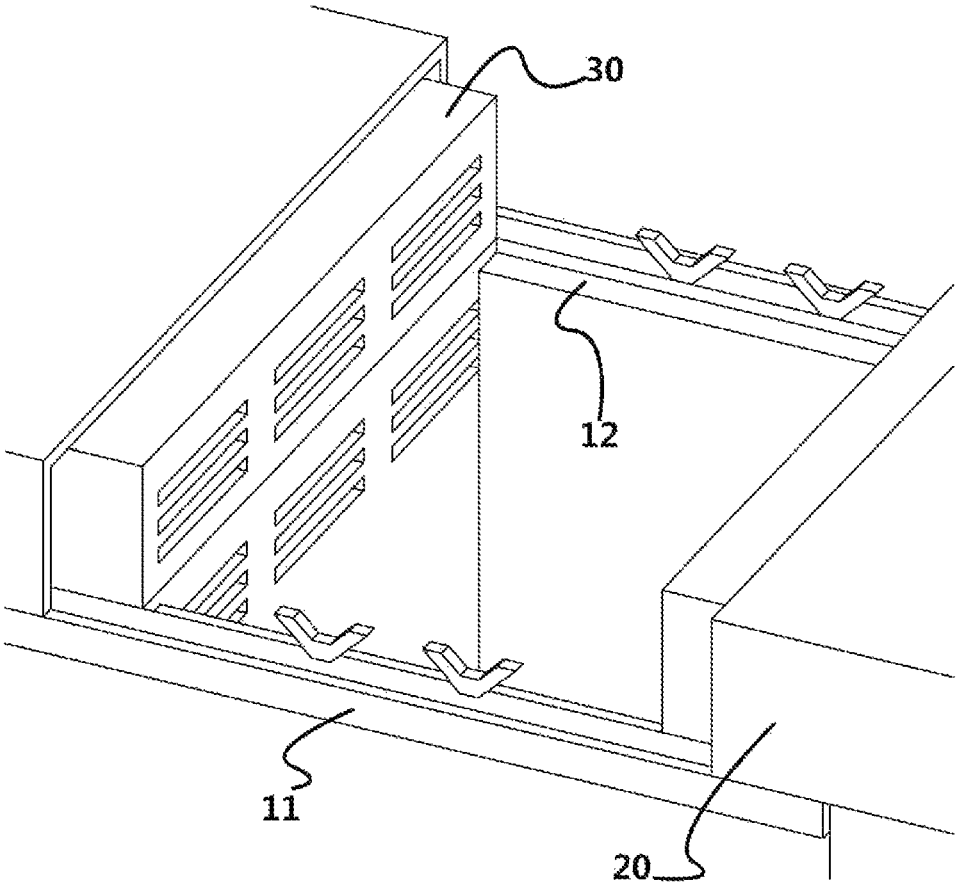
FIG. 5 is an enlarged perspective view showing a portion of top of FIG. 2.

FIG. 1 is a perspective view showing a state where doors located on top of a tank are open in a method for exhausting high concentrations of toxic gases generated during chemical stripping for high-temperature parts of a gas turbine according to the present invention, FIG. 2 is a perspective view showing a state where the doors and covers located on top of the tank are open in the method for exhausting high concentrations of toxic gases generated during chemical stripping for high-temperature parts of a gas turbine according to the present invention, FIG. 3 is a sectional view showing a state where the doors located on top of the tank are closed in the method for exhausting high concentrations of toxic gases generated during chemical stripping for high-temperature parts of a gas turbine according to the present invention, FIG. 4 is an enlarged perspective view showing a portion of top of FIG. 1, and FIG. 5 is an enlarged perspective view showing a portion of top of FIG. 2.

Generally, a method for removing a metal film (NiCoCrAlY, CoCrAlY, or NiCrAlY) as a bond coating layer coated on the surface of a high-temperature part (blade and vane) of a gas turbine according to the present invention includes the steps of: submerging the high-temperature part of the gas turbine into a tank where hydrochloric acid having the concentration range of to 35% and a temperature of 60° C. is accommodated and dissolving and removing the metal film through chemical reactions.

In this case, there are chemical equations as follows.

$$-Ni,Co+2HCl \leftrightarrow MCl_2+H_2/MCl_2+2HCl \leftrightarrow [MCl_2]^{2-}+2H^+$$

$$-Al+3HCl \leftrightarrow AlCl_3+1.5H_2/AlCl_3+HCl \leftrightarrow [AlCl_4]^-+H^+$$

$$-Cr+3HCl \leftrightarrow CrCl_3+1.5H_2/AlCl_3+HCl \leftrightarrow [AlCl_4]^-+H^+$$

wherein bond coating can be indicated as MCrALy coating (M is Co or Ni).

According to the present invention, as shown in FIGS. 1 to 5, there is provided a method for exhausting high concentrations of toxic gases generated during chemical stripping for high-temperature parts of a gas turbine, the method including the steps of: allowing a pair of openable/closable doors 20 mounted on top of a tank 10 whose top is open to accommodate a chemical substance therein to be closed during the chemical stripping so as to close top of the tank 10; collecting toxic gases generated from the interior of the tank 10 through hoods 30 located at the inside of the tank 10; and exhausting the toxic gases to the outside through exhaust pipes mounted on the hoods 30 or collecting the toxic gases to a separate storage tank.

Rails 11 are formed on both top sides of the tank 10, and accordingly, the doors 20 slide along the rails 11 to open and close the top of the tank 10.

Further, stoppers (not shown) are additionally mounted on both ends of the rails 11 to prevent the doors 20 from escaping from the ends of the rails 11.

The rails 11 for sliding the doors 20 therealong and the stoppers for preventing the escape of the doors 20 are widely known members, and therefore, detailed explanations on the rails 11 and the stoppers will be avoided for the brevity of the description.

Desirably, the doors 20 slide along the rails 11 located on both top sides of the tank 10 to open and close top of the tank 10. In detail, if the doors 20 are close to each other, the top of the tank 10 becomes closed, and if they are distant from each other, the top of the tank 10 becomes open.

Further, the doors 20 have given heights toward tops thereof, so that they have space portions formed on the undersides thereof in such a manner as to insertedly locate the hoods 30 for collecting the toxic gases generated from the tank 10 thereinto, without having any influence on the doors 20 moving along the rails 20.

In this case, the hoods 30 are located relatively lower than internal ceiling surfaces of the doors 20 between both top sides of the tank 10, thereby having no influence on the doors 20 moving along the rails 20.

Under normal circumstances where the chemical stripping is not performed, on the other hand, the doors 20 are kept open, and in this case, water vapor is produced from heat remaining in the tank 10. The water vapor contains the toxic gases, thereby making it hard to keep a workplace at a safe state.

So as to solve the above-mentioned problems, accordingly, plate-shaped covers 40 are separately mounted on the tank 10, and to do this, first, the tank 10 has stepped protrusions 12 formed on the insides of the both top sides where the rails 11 are located. Next, the plate-shaped covers 40 are seated onto the stepped protrusions 12 of the tank 10.

The covers 40 will be in detail explained below.

Figure 6:
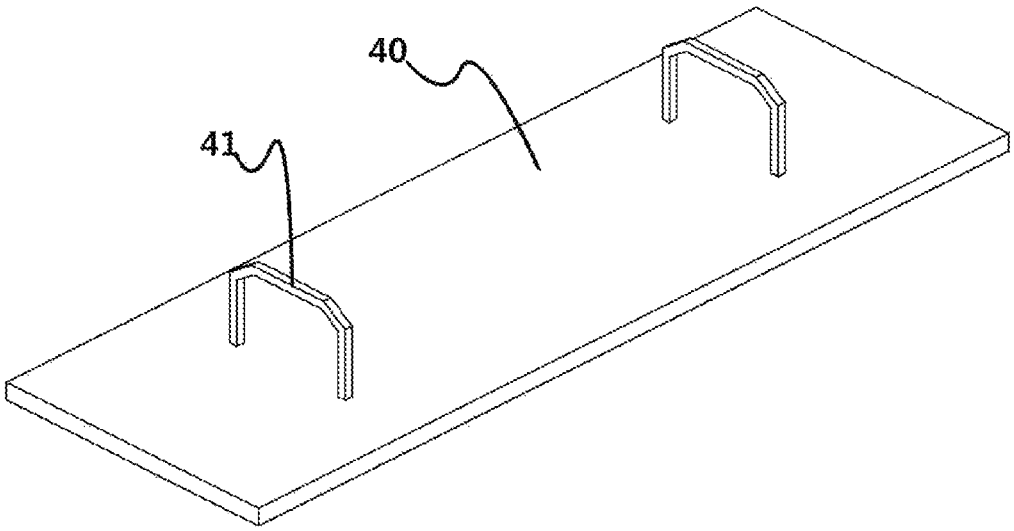
FIG. 6 is a perspective view showing top of the cover mounted on top of the tank in the method for exhausting high concentrations of toxic gases generated during chemical stripping for high-temperature parts of a gas turbine according to the present invention.
Figure 7:
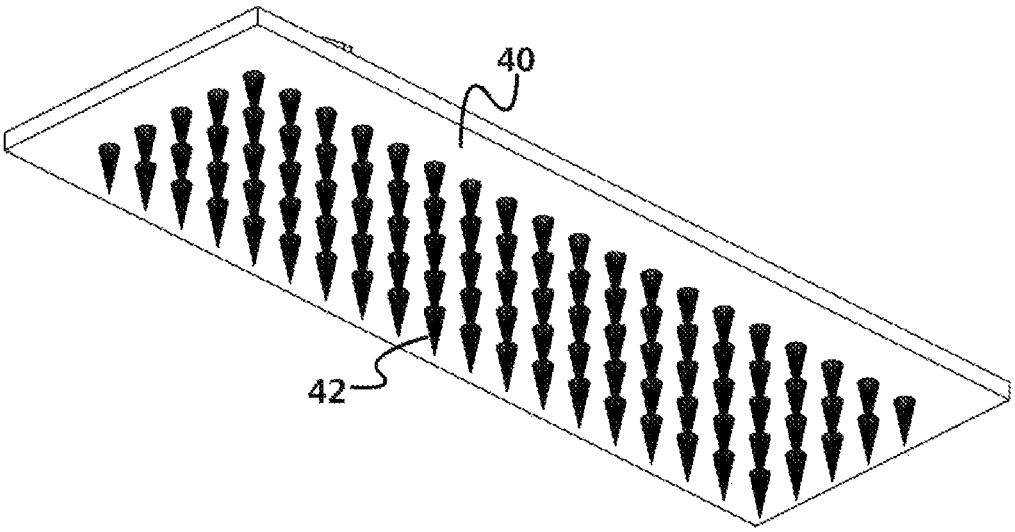
FIG. 7 is a perspective view showing underside of the cover mounted on top of the tank in the method for exhausting high concentrations of toxic gases generated during chemical stripping for high-temperature parts of a gas turbine according to the present invention.

FIG. 6 is a perspective view showing top of the cover mounted on top of the tank in the method for exhausting high concentrations of toxic gases generated during chemical stripping for high-temperature parts of a gas turbine according to the present invention, and FIG. 7 is a perspective view showing underside of the cover mounted on top of the tank in the method for exhausting high concentrations of toxic gases generated during chemical stripping for high-temperature parts of a gas turbine according to the present invention.

As shown in FIGS. 6 and 7, handles 41 are provided on tops of the plate-shaped covers 40 in such a manner as to be easily grasped by a worker.

On the other hand, the water vapor produced from the heat remaining in the tank 10 is not exhausted to the outside, but it gathers to the undersides of the covers 40, while having the shapes of water droplets.

The water vapor as the shapes of water droplets attached to the undersides of the covers 40 is a load added to the loads of the covers 40 themselves, and in a process of lifting the covers 40 up so as to perform new work, accordingly, the addition of the load of the water vapor gives many difficulties to the worker.

Accordingly, a plurality of induction needles 42 spaced apart from one another at given intervals in every direction are provided on undersides of the covers 40 in such a manner as to induce the water vapor attached to the undersides of the covers 40 and containing the toxic gases therein to fall down to the tank 10.

The induction needles 42 have the shapes of circular cones spaced apart from one another at given intervals in every direction.

However, the toxic gases remain in the interior of the tank 10 in the state of being not exhausted to the outside by means of the covers 40, and accordingly, porous channels 50 as means for exhausting the remaining toxic gases are formed on the inner side walls of the tank 10 to collect the remaining toxic gases. Next, the collected toxic gases are exhausted to the outside through separate exhaust pipes connected to the porous channels 50, and otherwise, they are collected to a separate storage tank.

As described above, the method for exhausting high concentrations of toxic gases generated during chemical stripping for high-temperature parts of a gas turbine according to the present invention can perform the chemical stripping safely in the state where the open top of the tank is closed by means of the doors, and can allow the open top of the tank to be kept closed by means of the covers even after the chemical stripping has been finished to thus prevent the toxic gases remaining in the tank from being exhausted to the outside, so that under normal circumstances where the chemical stripping is not performed, work environments can be kept safe.

The present invention may be modified in various ways and may have several exemplary embodiments. Terms used in this application are used to only describe specific exemplary embodiments and are not intended to restrict the present invention. Accordingly, it should be understood that the invention covers all the modifications, equivalents, and replacements within the idea and technical scope of the invention. Therefore, the present invention is not to be restricted by the embodiment but only by the appended claims.

What is claimed is:

1. A method for exhausting toxic gases generated during chemical stripping for high-temperature parts of a gas turbine, the method comprising the steps of:

allowing a pair of openable/closable doors (20) mounted on top of a tank (10) whose top is open to accommodate a chemical substance therein to be closed during the chemical stripping so as to close the top of the tank (10);

collecting the toxic gases generated from an interior of the tank (10) through hoods (30) located at the interior of the tank (10); and exhausting the toxic gases to an outside the tank through exhaust pipes mounted on the hoods (30) or collecting the toxic gases in a separate storage tank, wherein the tank (10) comprises rails (11) located on both top sides thereof so that the doors (20) slide along the rails (11) in such a manner as to open the top thereof if the doors (20) are less than a first predetermined distance apart from each other and to close the top thereof if the doors (20) are more than a second predetermined distance apart from each other, the doors (20) have given heights toward tops thereof so that the doors (20) have space portions formed on undersides thereof in such a manner as to insertedly locate the hoods (30) for collecting the toxic gases generated from the tank (10) thereinto, without having any influence on the doors (20) moving along the rails (20), the hoods 30 being located relatively lower than internal ceiling surfaces of the doors (20) between both top sides of the tank (10) to thus have no influence on the doors (20) moving along the rails (20), and the tank (10) comprises stepped protrusions (12) formed on the insides of the both top sides where the rails (11) are located in such a manner as to allow plate-shaped covers (40) to be seated thereonto to prevent toxic gases still remaining in the interior of the tank (10) in the state where the doors (20) are open from being exhausted to the outside.

2. The method according to claim 1, wherein the covers (40) comprise handles (41) provided on tops thereof in such a manner as to be grasped by a worker and a plurality of induction needles (42) spaced apart from one another at given intervals in every direction on the undersides thereof in such a manner as to induce water vapor attached to the undersides thereof and containing the toxic gases therein to fall down to the tank (10).

3. The method according to claim 2, wherein the tank (10) comprises porous channels (50) formed on the inner side walls thereof to collect the toxic gases generated from the interior thereof in a state where the covers (40) are seated thereonto.

* * * * *